US006693597B2

(12) United States Patent
Walton et al.

(10) Patent No.: US 6,693,597 B2
(45) Date of Patent: Feb. 17, 2004

(54) LAYOUT FOR AUTOMOTIVE WINDOW ANTENNA

(75) Inventors: Eric K. Walton, Columbus, OH (US); Yasutaka Horiki, Columbus, OH (US); Martino Rosin, Vicehza (IT)

(73) Assignees: The Ohio State University Research Foundation, Columbus, OH (US); Calear s.r.l., Isola Vicentina (IT)

( * ) Notice: Subject to any disclaimer, the term of this patent is extended or adjusted under 35 U.S.C. 154(b) by 0 days.

(21) Appl. No.: 10/127,915

(22) Filed: Apr. 23, 2002

(65) Prior Publication Data

US 2003/0197650 A1 Oct. 23, 2003

(51) Int. Cl.[7] ..... H01Q 1/32; H01Q 1/02
(52) U.S. Cl. ..... 343/713; 343/704
(58) Field of Search ..... 343/713, 704, 343/769, 711, 712, 767

(56) References Cited

U.S. PATENT DOCUMENTS

| | | | | |
|---|---|---|---|---|
| 4,475,108 A | | 10/1984 | Moser | 343/700 |
| 4,764,773 A | | 8/1988 | Larsen et al. | 343/713 |
| 5,014,346 A | | 5/1991 | Phillips et al. | 455/89 |
| 5,138,330 A | | 8/1992 | Lindenmeier et al. | 343/713 |
| 5,293,177 A | | 3/1994 | Sakurai et al. | 343/906 |
| 5,355,144 A | * | 10/1994 | Walton et al. | 343/713 |
| 5,577,269 A | | 11/1996 | Ludewig | 455/90 |
| 5,739,790 A | | 4/1998 | Green, Jr. | 343/702 |
| 5,812,098 A | | 9/1998 | Harris et al. | 343/906 |
| 5,821,904 A | | 10/1998 | Kakizawa et al. | 343/704 |
| 5,945,957 A | | 8/1999 | Kakizawa | 343/713 |
| 5,999,134 A | | 12/1999 | Dishart et al. | 343/713 |
| 6,087,996 A | | 7/2000 | Dery | 343/713 |
| 6,208,303 B1 | * | 3/2001 | Tachihara et al. | 343/704 |

* cited by examiner

*Primary Examiner*—James Clinger
(74) *Attorney, Agent, or Firm*—Standley Law Group LLP

(57) ABSTRACT

An improved wire pattern layout for a window antenna that takes into account the characteristics of radio frequency current flow and the impact of a heater grid pattern. The wire pattern layout comprises a heating grid that is adapted to be in electrical communication with a DC power source. A plurality of antenna wires traverse the heating grid. The antenna wires are adapted to be in electrical communication with a feed to a radio frequency device such as an AM radio, a FM radio, an AM/FM radio, a CB radio, a cellular phone, a global positioning system, or combinations thereof. The antenna wires may extend across the heating grid in substantially straight lines or in a step-wise fashion. In addition, the antenna wires may change direction while traversing the heating grid. By taking into account the characteristics of radio frequency current flow and the impact of a heater grid pattern, the improved design of the wire pattern layout provides enhanced directional gain and impedance characteristics.

41 Claims, 17 Drawing Sheets

LAYOUT FOR AUTOMOTIVE WINDOW ANTENNA

BACKGROUND OF THE INVENTION

The present invention relates generally to a layout for an antena. More particularly, the present invention relates primarily to a layout for a radio frequency (RF) antena. An example of a RF antena is a window antena for a vehicle or other automotive means.

Modern automotive means may need an antenna to support RF communication. A number of devices may function using RF communication. For m instance, AM radios, FM radios, AM/FM radios, CB radios, cellular phones, and global positioning systems are dependent on RF communication.

A modern automobile may have a glass window that serves as a dielectric support for a wire pattern layout of a RF antenna. Typically, a rear window is used for such purposes. A pattern of wires printed or imbedded in the glass (i.e., printed lines) may permit RF current flow to and from the desired RF device.

The rear window of a typical automobile also has a pattern of printed lines that enables DC current flow. DC current causes these printed lines to act as heating elements. As a result, these lines may be used to defrost or defog the rear window, thereby enabling a driver to see out the rear window. To adequately serve this purpose, the heating elements typically cover a substantial area of the rear window. As a result, there is usually insufficient area for an isolated wire pattern layout for a traditional RF antenna. Consequently, the heating elements interfere with operation of the traditional RF antenna, causing the traditional RF antenna to exhibit relatively poor pattern control and impedance matching over the desired frequency band.

SUMMARY OF THE INVENTION

The present invention provides an improved layout for an antenna. The antenna design of present invention takes into account the characteristics of RF current flow and the impact of a heater grid pattern. As a result, exemplary embodiments of the present invention provide improved directional gain patterns and impedance characteristics as compared to traditional window antenna designs.

One embodiment of a wire pattern layout comprises a plurality of power wires and an antenna wire. The power wires are adapted to, be in electrical communication with a power source, e.g., a DC power source. An example of the power wires includes, but is not limited to, the printed lines of a heater grid pattern. The power wires may be arranged in any desired pattern. In a common heater grid pattern, the power wires are arranged in approximately parallel rows. The antenna wire traverses some or all of the power wires. In one embodiment, the antenna wire has a configuration that extends at an oblique angle across the power wires. In other words, an imaginary axis or generally central line of the configuration extends at an oblique angle across the power wires. There may be at least one change of direction of the configuration as the antenna wire extends across the power wires. The antenna wire is adapted to be in electrical communication with a feed to a radio frequency device.

The shape of the antenna wire may be selected to achieve optimal pattern control and impedance characteristics. In one exemplary embodiment, the antenna wire has a substantially straight line configuration. In another exemplary embodiment, the configuration of the antenna wire is a step pattern. The angle of each step may be selected to achieve the optimal antenna characteristics. The inventors have discovered that steps of about 90 degrees may be preferred in some embodiments to prevent or limit interference with the heater grid power flow. In other words, the antenna wire may intersect each power wire at an angle of approximately 90 degrees to limit interference with the heater grid power flow. For optimal results in some embodiments, there may be at least one change in direction of the antenna wire. For instance, a straight line may change directions, or a step pattern may change directions. In one exemplary embodiment, the antenna wire may have a "V" or "W" shape. Of course, some embodiments of the present invention may include at least one additional antenna wire that is also adapted to be in electrical communication with the feed to the radio frequency device. Each additional antenna wire may include any of the optional or preferred features of the above-described antenna wire.

The wire pattern layout may be supported by any suitable means. For example, the power wires and the antenna wire(s) may be printed lines that are supported by at least one dielectric panel. One example of a dielectric panel is an automotive window.

The antenna wire(s) may be adapted to be in electrical communication with any suitable device. For instance, the antenna wire(s) may be connected to a suitable RF device. Examples of RF devices include, but are not limited to, AM radios, FM radios, AM/FM radios, CB radios, global positioning systems, cellular phones, and various combinations of such devices.

The present invention includes another embodiment of a wire pattern layout for an antenna. This embodiment may include any of the optional or preferred features of the other embodiments of the present invention. In this embodiment, the wire pattern layout comprises at least one dielectric panel that supports a plurality of power wires, an antenna feed, and a plurality of antenna wires. The power wires are in electrical communication with a power source, and the feed is in electrical communication with a radio frequency device. The antenna wires are in electrical communication with the feed. At least one of the antenna wires has a configuration that extends at an oblique angle across the power wires.

Yet another embodiment of a wire pattern layout for an antenna is included in the present invention. This embodiment may include any of the optional or preferred features of the other embodiments of the present invention. This example of the wire pattern layout comprises an antenna feed and two wire arrays. The feed is adapted to be in electrical communication with a radio frequency device. The first wire array is in electrical communication with the feed. The first wire array comprises a plurality of intersecting antenna wires. In one exemplary embodiment, the first wire array may also include an additional antenna wire that extends at least partially around the second wire array. The second wire array comprises a plurality of power wires and at least one antenna wire. The first wire array may be electromagnetically coupled to the antenna wire(s) of the second wire array. In one example, a coupling wire may be connected to the first wire array, wherein the coupling wire facilitates electromagnetic coupling of the first wire array to the antenna wire(s) of the second wire array. The power wires are adapted to be in electrical communication with a power source, and the antenna wire(s) of the second wire array traverse the power wires. In one exemplary embodiment, an antenna wire of the second wire array may have a configuration that extends at an oblique angle across the power wires. In other embodiments, an antenna wire of the second wire array may be a straight line that is perpendicular to the power wires.

The antenna wires of the first array may intersect in any suitable pattern. In one embodiment, the intersecting antenna wires of the first wire array may include a plurality of approximately horizontally oriented antenna wires and at least one approximately vertically oriented antenna wire. The approximately vertically oriented antenna wire may traverse some or all of the approximately horizontally oriented antenna wires. As in previously described embodiments, the antenna wires of the first and second wire arrays may include any suitable shapes. In an exemplary embodiment, the first and second wire arrays are supported by a window of an automobile, and the first wire array is situated above and substantially adjacent to the second wire array.

In another embodiment of the present invention, a wire pattern layout for an antenna comprises two antenna wires that are coupled together. A feed is adapted to be in electrical communication with a radio frequency device. A first antenna wire is in electrical communication with the feed. The second antenna wire is included in a wire array. The wire array also includes a plurality of power wires that are adapted to be in electrical communication with a power source. The second antenna wire intersects the power wires, and it is electromagnetically coupled to the first antenna wire. This embodiment of the present invention may also include any of the optional or preferred features of the other embodiments of the present invention.

The present invention includes another embodiment of an antenna layout. This example may include any of the optional or preferred features of the other embodiments of the present invention. In this example, a feed is adapted to be in electrical communication with a radio frequency device. A metallic film is in electrical communication with the feed. A wire array may also be included. The wire array comprises a plurality of power wires, and it is adapted to be in electrical communication with a power source. The metallic film and the wire array are supported by at least one dielectric panel.

Another embodiment of the present invention includes a first dielectric panel that is connected to a second dielectric panel. An antenna is supported by the first dielectric panel, whereas the second dielectric panel supports a heater layout. The heater layout may comprise a plurality of power wires adapted to be in electrical communication with a power source. The dielectric panels may be comprised of any suitable dielectric materials. In one example, the first dielectric panel is comprised of plastic, and the second dielectric panel is comprised of glass. Some other examples of dielectric materials include, but are not limited to, safety glass, polycarbonate, plexiglass, and fiberglass. In addition, this embodiment may include any of the optional or preferred features of the other embodiments of the present invention.

In addition to the novel features and advantages mentioned above, other features and advantages of the present invention will be readily apparent from the following descriptions of the drawings and exemplary embodiments.

DETAILED DESCRIPTION OF EXEMPLARY EMBODIMENT(S)

The present invention is directed to a layout for an antenna. The present invention will be described primarily herein with regard to a RF antenna embodiment for an automotive window. However, the present invention is not limited to that particular embodiment. The present invention may be useful for frequencies outside (i.e., above or below) of the RF range. Accordingly, the present invention is not limited to use with RF devices such AM and FM devices. Also, the wire pattern layout of the present invention may be supported or otherwise suspended in any suitable dielectric material including, but not limited to, windows and other glass objects, plastics, air, or any other similar, suitable, or conventional dielectric material. Examples of glass include, but are not limited to, safety glass and fiberglass. Examples of plastics include, but are not limited to, polycarbonate and plexiglass. Furthermore, the present invention is not limited to a layout of an antenna for a vehicle or other automotive means. The present invention may be useful for any type of antenna application. As used herein, the term wire shall be understood to include printed lines of conductive material, rigid filaments or rods of conductive material, flexible filaments or rods of conductive material, and other types of electrical conductors that are encompassed within the conventional meaning of the term wire.

Figure 1:
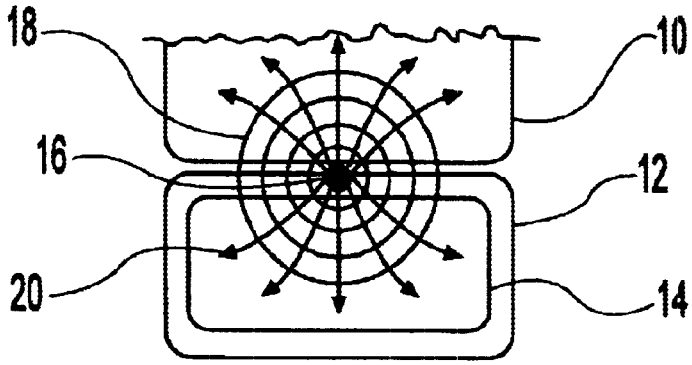
FIG. 1 is a schematic diagram showing the typical direction of RF current flow throughout a vehicle body.

FIG. 1 is a schematic view which shows that a vehicle body may have an impact on the design of the wire pattern layout of an antenna. FIG. 1 shows a roof panel 10 that is situated adjacent to a window 12. A metal panel 14 is secured to the window 12. The metal panel 14 is in electrical communication with an antenna feed 16. Theoretical equipotential lines 18 are shown for illustration purposes. In such an embodiment, RF current in the AM and FM frequency bands flows radially from the feed 16 as indicated by arrows 20. As a result, the entire body of the vehicle essentially becomes a part of the antenna as the RF current flows throughout the metal panels of the vehicle body. Accordingly, the present invention takes this phenomenon into account in the design of the wire pattern layout of antenna. Consequently, exemplary embodiments of the present invention exhibit improved pattern control and impedance matching over the desired frequency band as compared to traditional wire pattern layouts.

Figure 2:
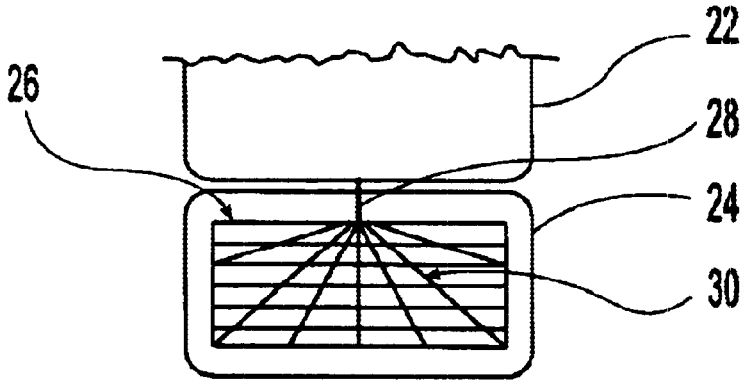
FIG. 2 is a schematic diagram of one exemplary embodiment of a wire pattern lay out of the present invention.

FIG. 2 shows one embodiment of a wire pattern layout of the present invention. In FIG. 2, a roof panel 22 is situated adjacent to a window 24. A grid of approximately horizontal power wires 26 extend across the window. For example, the power wires 26 may function as heating elements by conducting DC current, thereby defogging or defrosting the window 24. An antenna feed 28 is in electrical communication with at least one antenna wire 30. In this example, a plurality of antenna wires 30 traverse the power wires 26. The antenna wires 30 of this embodiment include a plurality of oblique lines and one line that is approximately perpendicular to the power wires 26. Accordingly, this embodiment of the wire pattern layout is an efficient and improved antenna design because it accommodates the natural direction of RF current flow.

Figure 3:
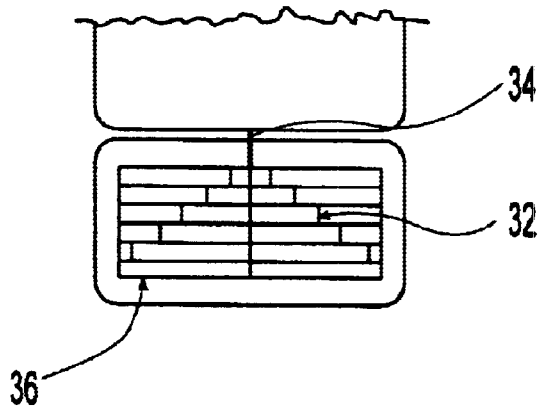
FIG. 3 is a schematic diagram of one exemplary embodiment of a wire pattern layout of the present invention.

FIG. 3 shows another example of a wire pattern layout of the present invention. In this embodiment, at least one antenna wire 32 is in electrical communication with a feed 34 and extends in a step pattern across the power lines 36. This embodiment may offer some advantages over the embodiment of FIG. 2. By implementing a step pattern, each antenna wire 32 intersects adjacent power lines 36 at points of approximately equal voltage potential. As a result, this step pattern may substantially limit the possibility that an antenna wire 32 will also carry DC current that may be flowing through the power lines 36. On the other hand, the oblique antenna wires 30 of FIG. 2 intersect adjacent power lines 26 at points of different voltage potential, which may result in the oblique antenna wires 30 also carrying DC current. The heating characteristics of the defogger or defroster may be negatively impacted if an antenna wire is carrying DC current. Consequently, the inventors have discovered that the embodiment of FIG. 3 may offer improved performance over the embodiment of FIG. 2, even though the embodiment of FIG. 2 may be a significant improvement over traditional designs.

Based on the aforementioned concepts, a number of designs have been built and tested. However, the present invention is not limited to the exemplary dimensions and configurations provided throughout the examples. The dimensions and configuration of each layout of the present invention may be selected to achieve the desired antenna characteristics, which will vary according to the location and intended use of each antenna.

EXAMPLES

Figure 4:
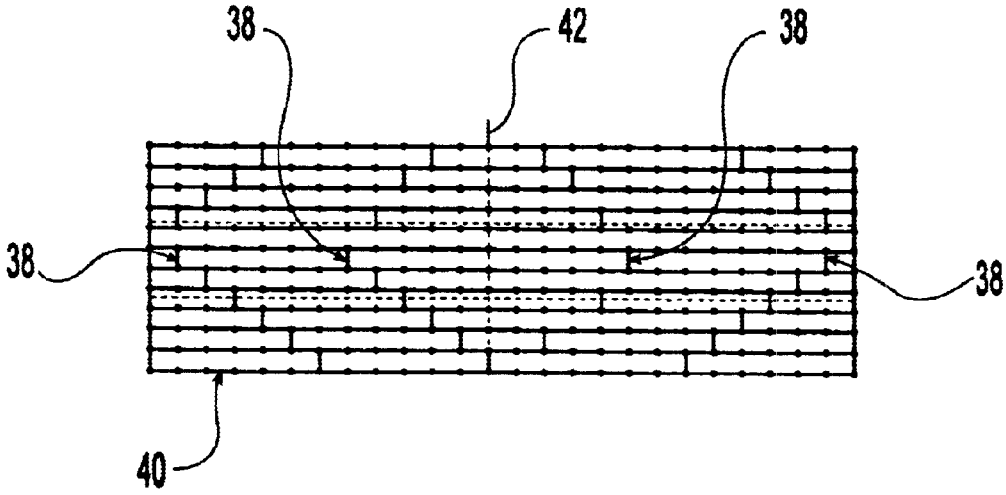
FIG. 4 is a diagram of one exemplary embodiment of a wire pattern layout of the present invention.
Figure 5:
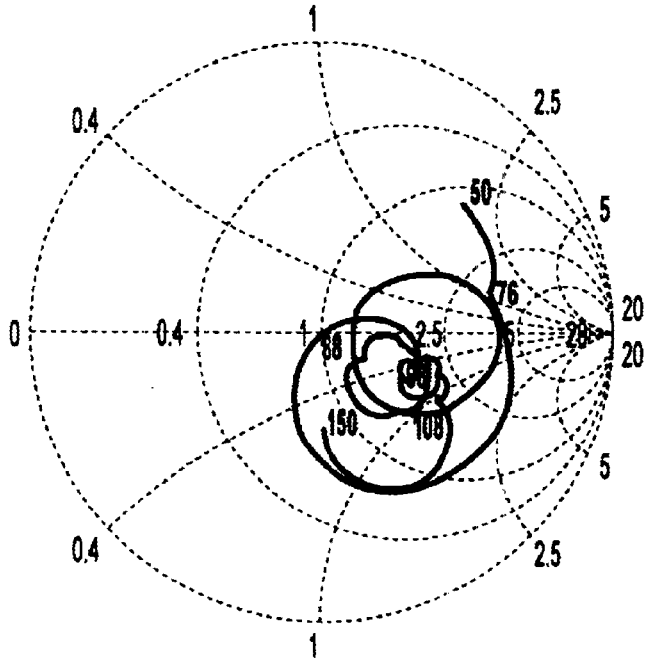
FIG. 5 is a plot of the impedance characteristics of the wire pattern layout shown in FIG. 4.
Figure 6:
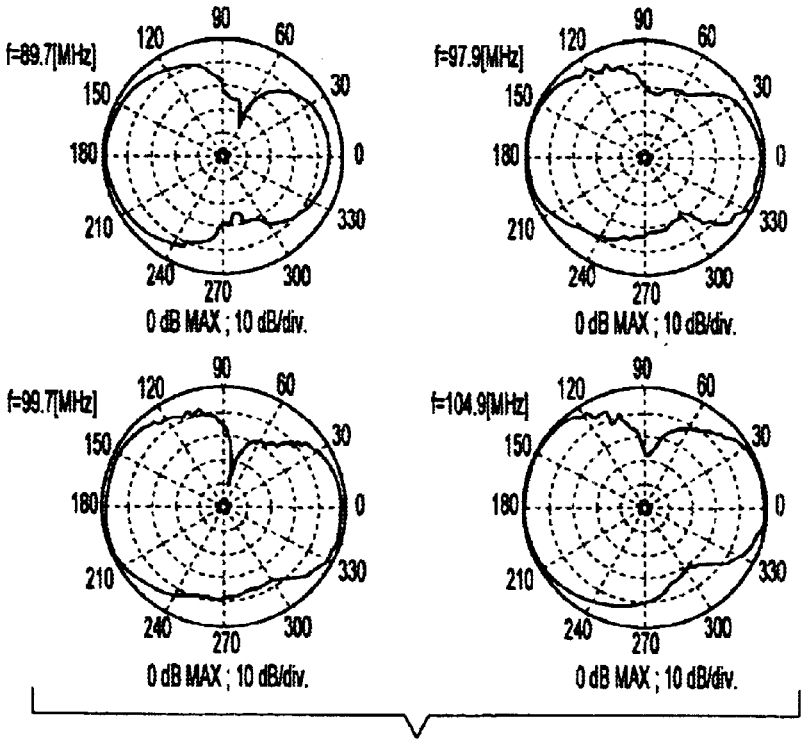
FIG. 6 illustrates plots of the directional gain pattern of the wire pattern layout shown in FIG. 4.

FIG. 4 illustrates a wire pattern layout in which each antenna line 38 changes direction in a step-wise fashion while traversing the grid of substantially horizontal power lines 40. In this particular embodiment, each antenna line 38 is generally V-shaped. It should be recognized that the direction of an antenna wire may change multiple times and have, for example, a W-shape. FIG. 5 is a plot of the impedance characteristics of the embodiment shown in FIG. 4, and FIG. 6 shows plots of the direction gain pattern at different frequencies of the embodiment shown in FIG. 4. In each instance, the embodiment of FIG. 4 provided significantly improved results over traditional wire pattern layouts.

Figure 7:
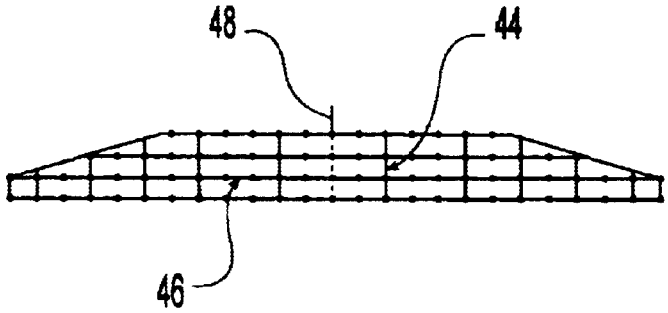
FIG. 7 is a diagram of one exemplary embodiment of a wire pattern layout of the present invention.
Figure 8:
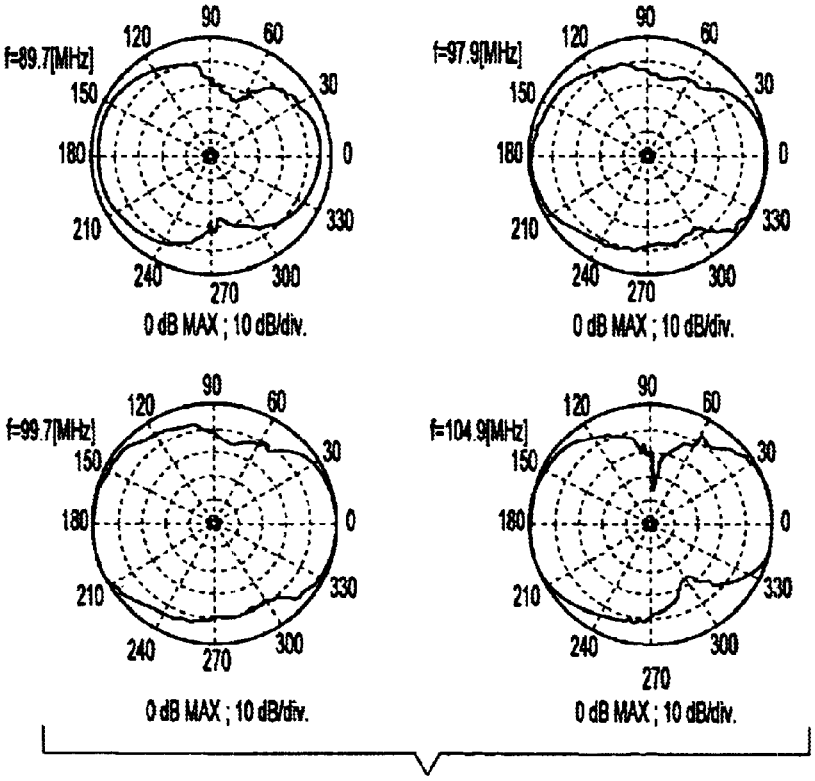
FIG. 8 illustrates plots of the directional gain pattern of the wire pattern layout shown in FIG. 7.

FIG. 7 shows an embodiment of the present invention that is comprised of a plurality of intersecting antenna wires. In this embodiment, at least one approximately vertically oriented antenna wire 44 traverses a plurality of approximately horizontally oriented antenna wires 46. Each of the antenna wires 46, 48 is in electrical communication with an antenna feed 48. This layout utilizes a sufficient number of wire interconnects to permit a natural flow of RF current over the entire pattern. Consequently, this embodiment also offered directional gains as shown in FIG. 8 that compare very well to traditional on-glass antennas. It should be recognized that an antenna wire pattern such as shown in FIG. 7 may be used alone or in conjunction with another antenna wire pattern. For example, one antenna wire pattern may be in direct electrical communication with, or electromagnetically coupled to, another antenna wire pattern.

A number of other wire pattern layouts were tested using a network analyzer to measure the $S_{11}$ parameter of each configuration. The dimensions of the heater grid used in each of the tests were approximately: top length=100 cm; bottom length=118 cm; and height=30 cm. In each of the remaining diagrams of the exemplary wire pattern layouts, the antenna feed is indicated as F.

Figure 9:
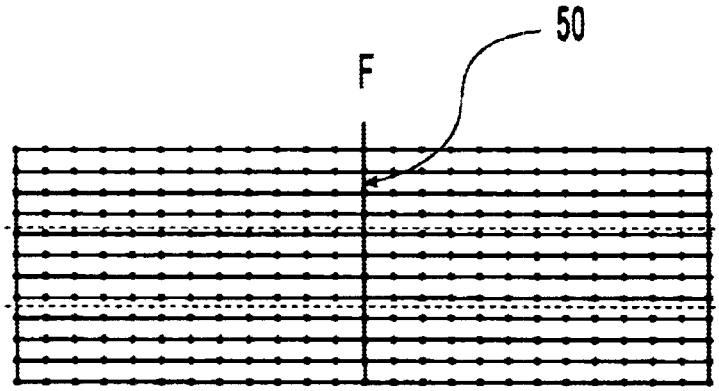
FIG. 9 is a diagram of one exemplary embodiment of a wire pattern layout of the present invention.
Figure 10:
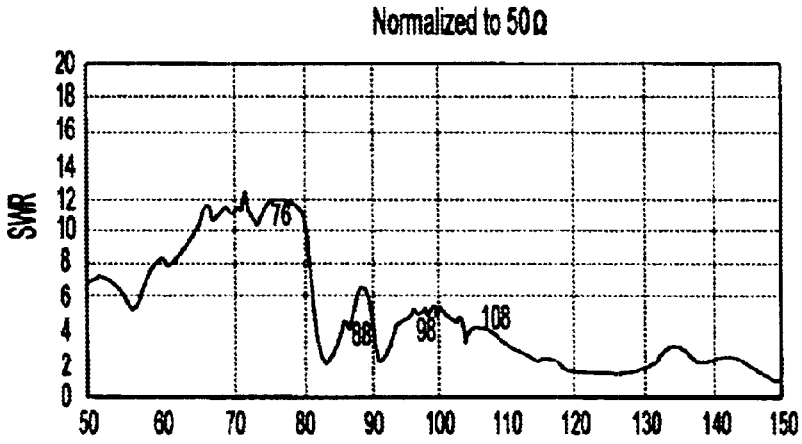
FIG. 10 is a plot of the test results of the wire pattern layout shown in FIG. 9.

The layout of FIG. 9 has one vertical antenna wire 50 that traverses the heater grid. The test results of this embodiment are shown in FIG. 10.

Figure 11:
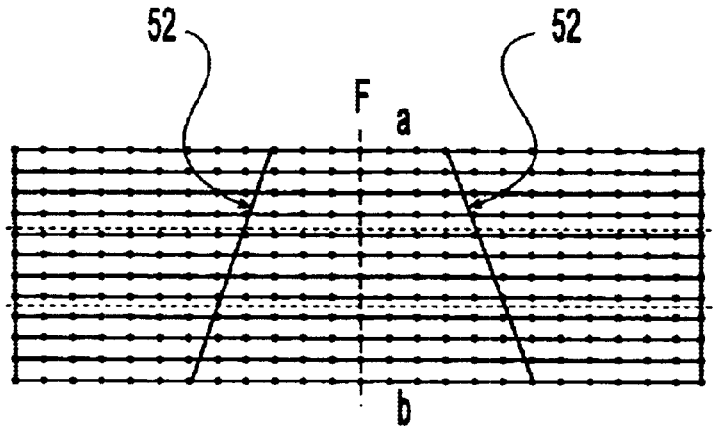
FIG. 11 is a diagram of one exemplary embodiment of a wire pattern layout of the present invention.
Figure 12:
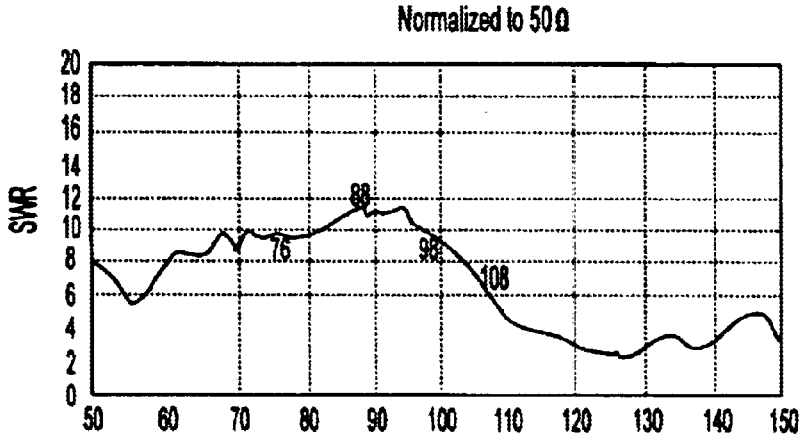
FIG. 12 is a plot of the test results of the wire pattern layout shown in FIG. 11.

The wire pattern of FIG. 11 has two oblique antenna wires 52 that extend across the heater grid. The distance a is about 11.5 cm, and the distance b is about 26 cm. The test results of this wire pattern are shown in FIG. 12.

Figure 13:
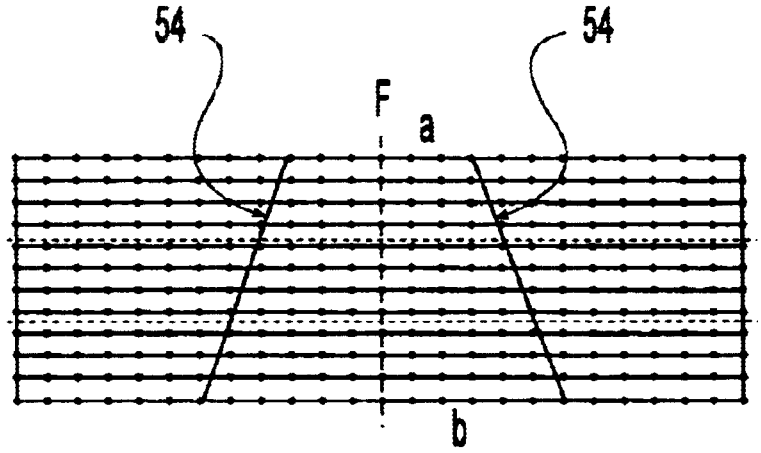
FIG. 13 is a diagram of one exemplary embodiment of a wire pattern layout of the present invention.
Figure 14:
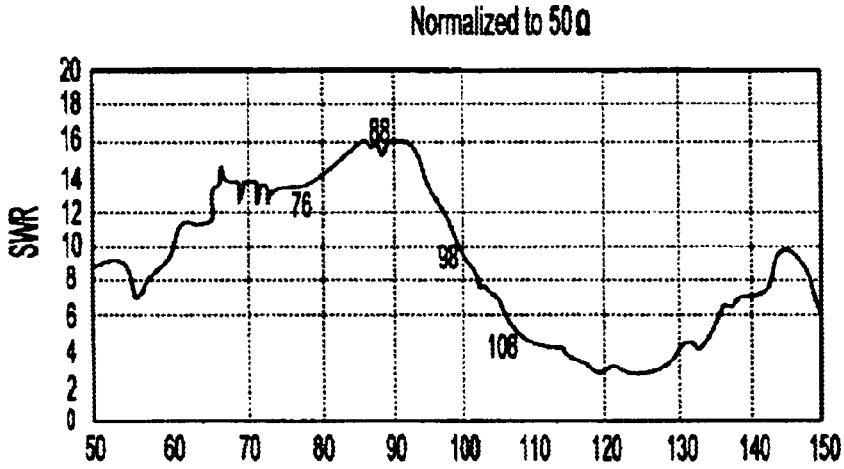
FIG. 14 is a plot of the test results of the wire pattern layout shown in FIG. 13.

The wire pattern of FIG. 13 also has two oblique antenna lines 54 that extend across the heater grid. However, in this embodiment, the distance a is about 21.5 cm, and the distance b is about 36 cm. The test results of this wire pattern are shown in FIG. 14.

Figure 15:
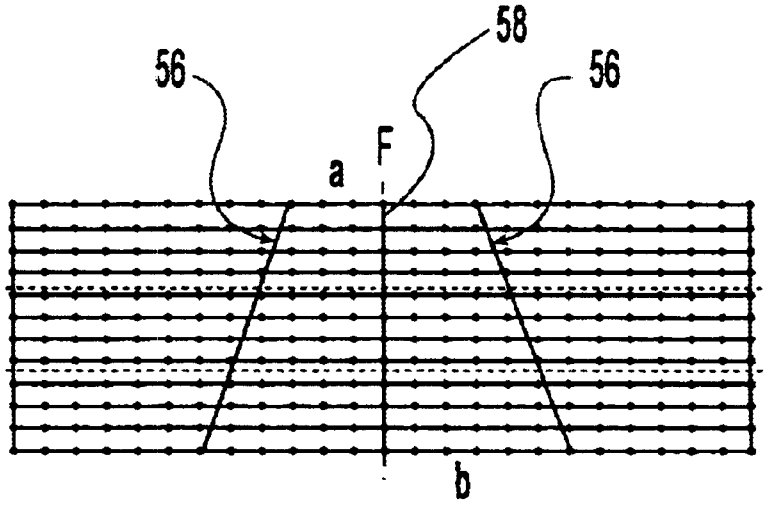
FIG. 15 is a diagram of one exemplary embodiment of a wire pattern layout of the present invention.
Figure 16:
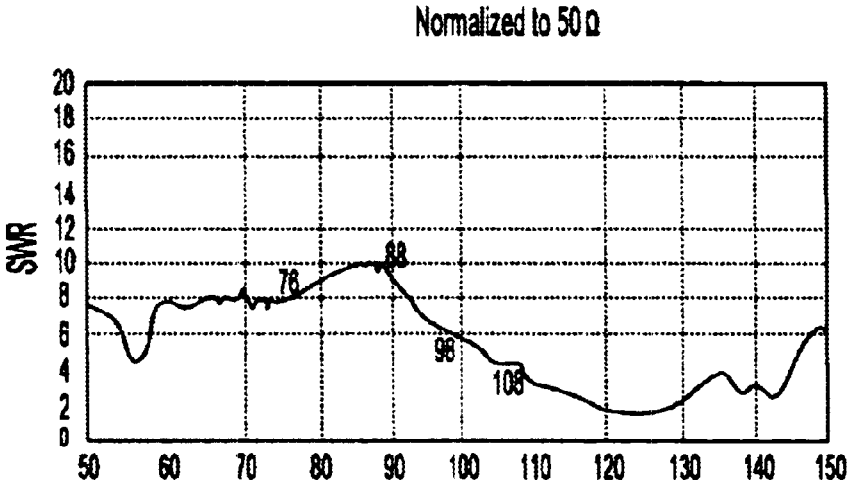
FIG. 16 is a plot of the test results of the wire pattern layout shown in FIG. 15.

In FIG. 15, the wire pattern layout has two oblique antenna lines 56 as well as a vertical antenna line 58. In this embodiment, the distance a is about 21.5 cm, and the distance b is about 36 cm. The test results of this wire pattern are shown in FIG. 16.

Figure 17:
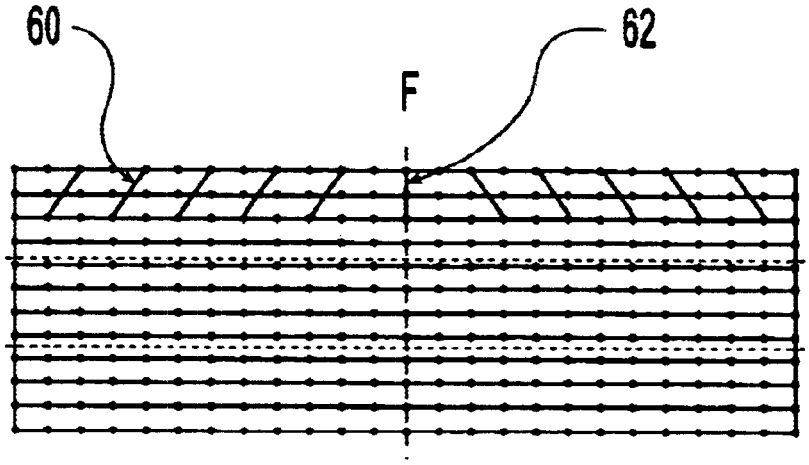
FIG. 17 is a diagram of one exemplary embodiment of a wire pattern layout of the present invention.
Figure 18:
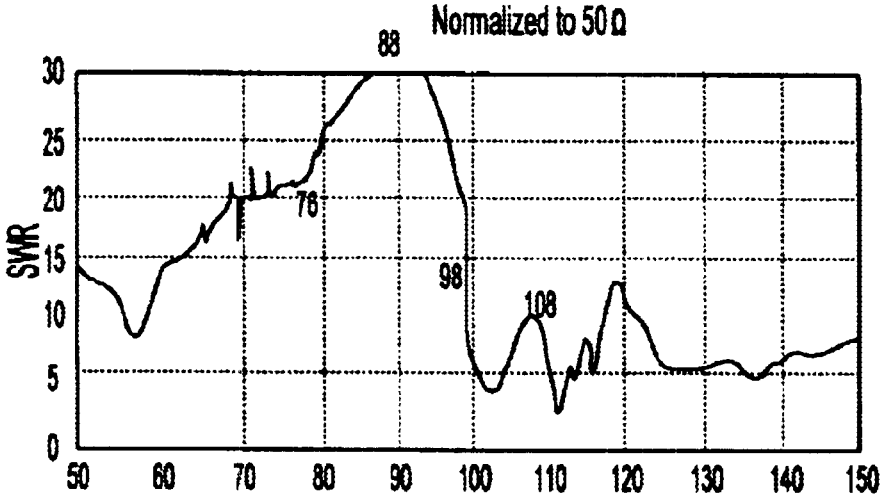
FIG. 18 is a plot of the test results of the wire pattern layout shown in FIG. 17.

The embodiment of FIG. 17 is comprised of 10 oblique antenna lines 60 and 1 substantially vertical antenna line 62. The antenna wires 60, 62 only traverse the first three power lines of the heater grid. FIG. 18 shows the test results for this example.

Figure 19:
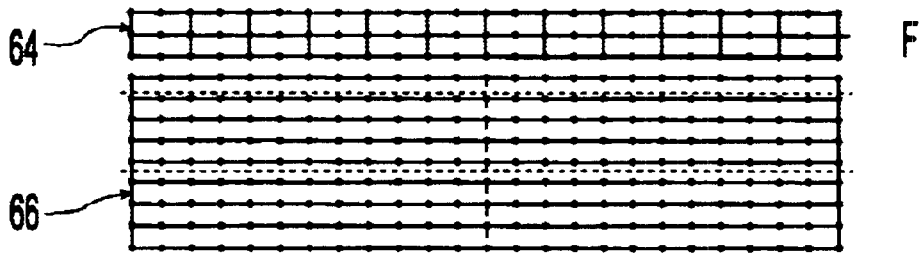
FIG. 19 is a diagram of one exemplary embodiment of a wire pattern layout of the present invention.

FIG. 19 illustrates an embodiment in which an antenna array 64 is over and isolated from the heater grid 66. The antenna array 64 has a side antenna feed F.

Figure 20:
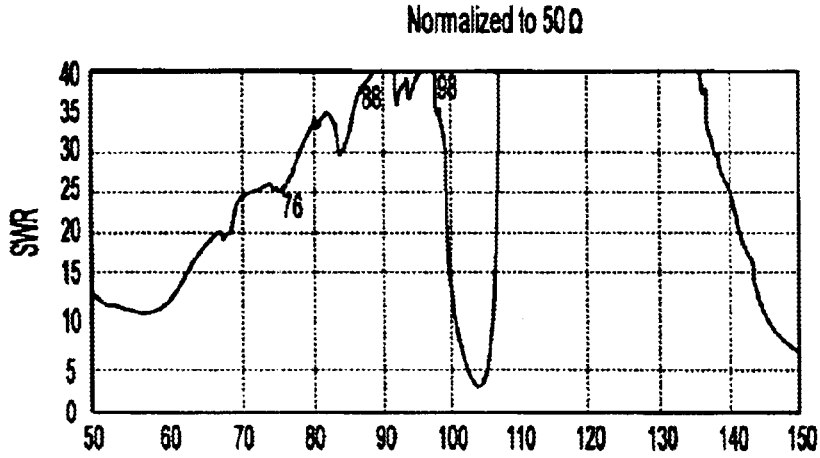
FIG. 20 is a plot of the test results of the wire pattern layout shown in FIG. 19.

In this embodiment of the present invention, the antenna pattern 64 does not traverse the heater grid 66. The test results are shown in FIG. 20.

Figure 21:
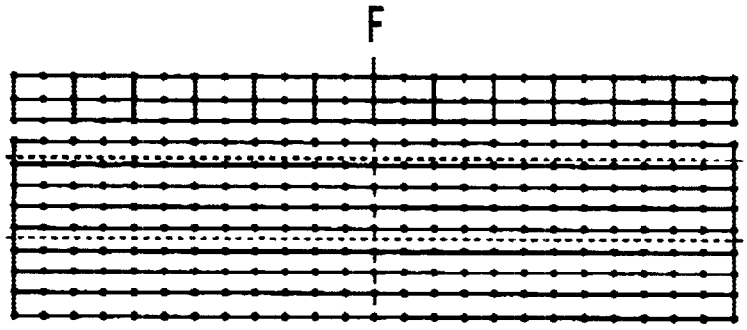
FIG. 21 is a diagram of one exemplary embodiment of a wire pattern layout of the present invention.
Figure 22:
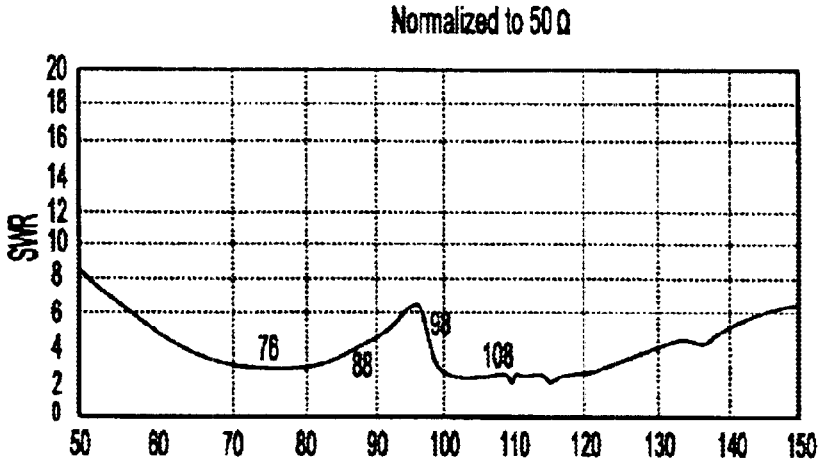
FIG. 22 is a plot of the test results of the wire pattern layout shown in FIG. 21.

The layout of FIG. 21 is similar to the layout of FIG. 19, except that there is a central antenna feed F. FIG. 22 shows the test result for this embodiment.

Figure 23:
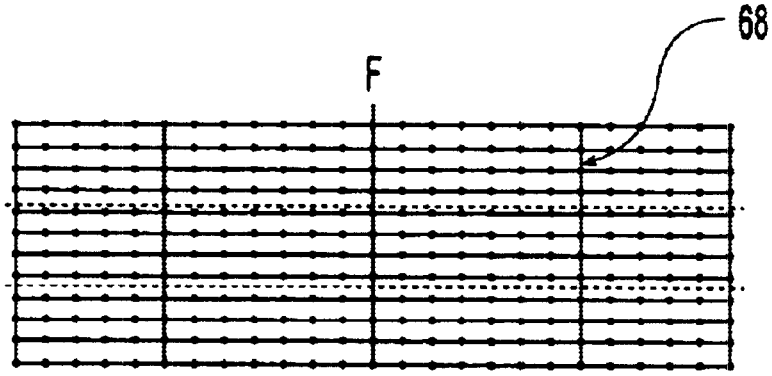
FIG. 23 is a diagram of one exemplary embodiment of a wire pattern layout of the present invention.
Figure 24:
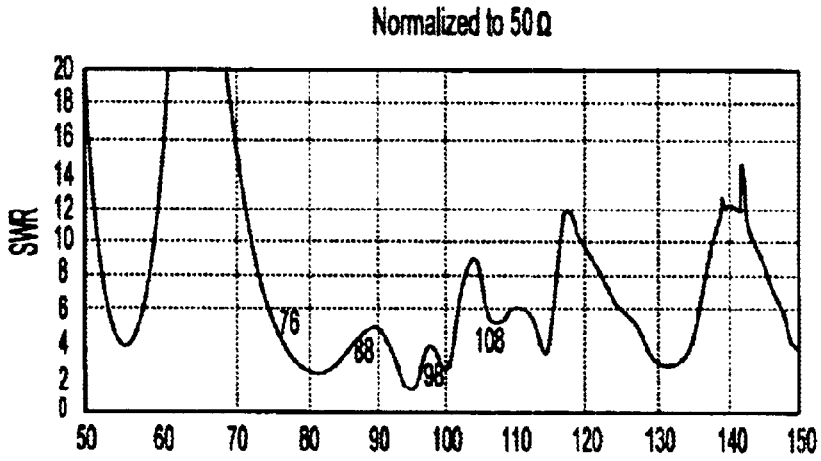
FIG. 24 is a plot of the test results of the wire pattern layout shown in FIG. 23.

FIG. 23 shows three substantially vertical antenna wires 68 traversing the heater grid. The test results regarding the layout of FIG. 23 are shown in FIG. 24.

Figure 25:
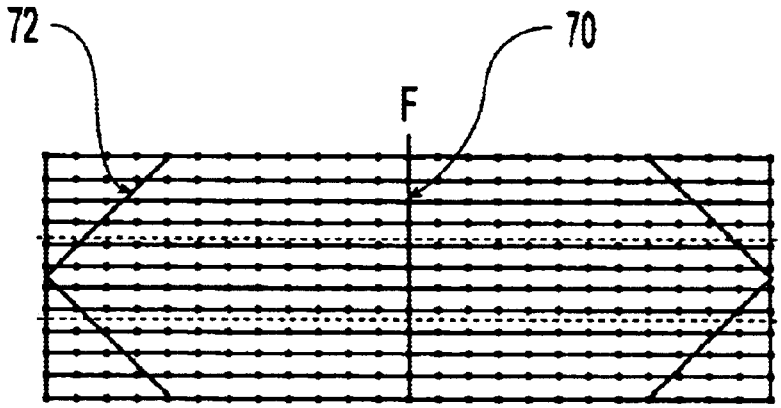
FIG. 25 is a diagram of one exemplary embodiment of a wire pattern layout of the present invention.
Figure 26:
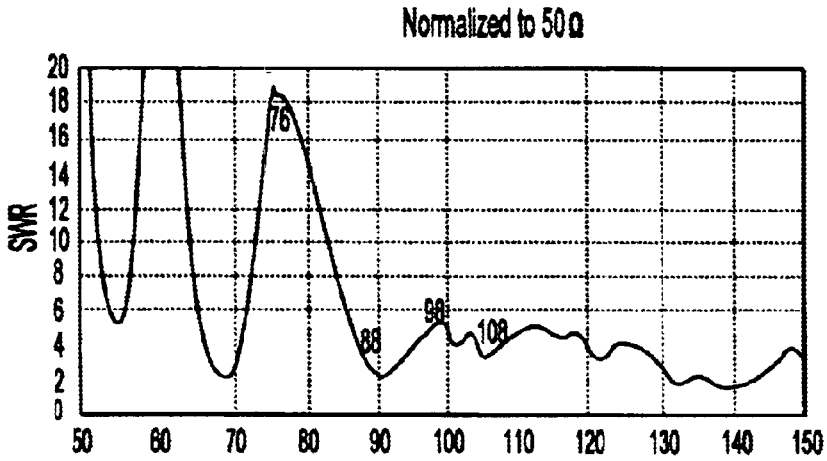
FIG. 26 is a plot of the test results of the wire pattern layout shown in FIG. 25.

In FIG. 25, the layout is comprised of a vertical antenna line 70 and two "rhomboidal" antenna lines 72. In this particular example, each of the "rhomboidal" antenna lines 72 have one change in direction, thereby forming a V-shape. The test results are shown in FIG. 26.

Figure 27:
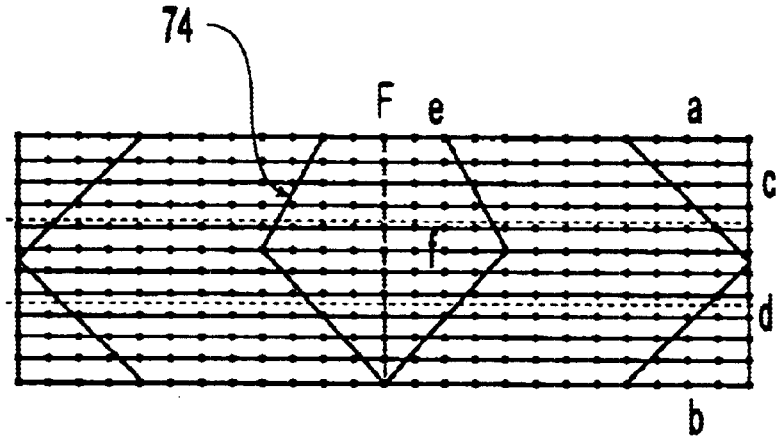
FIG. 27 is a diagram of one exemplary embodiment of a wire pattern layout of the present invention.
Figure 28:
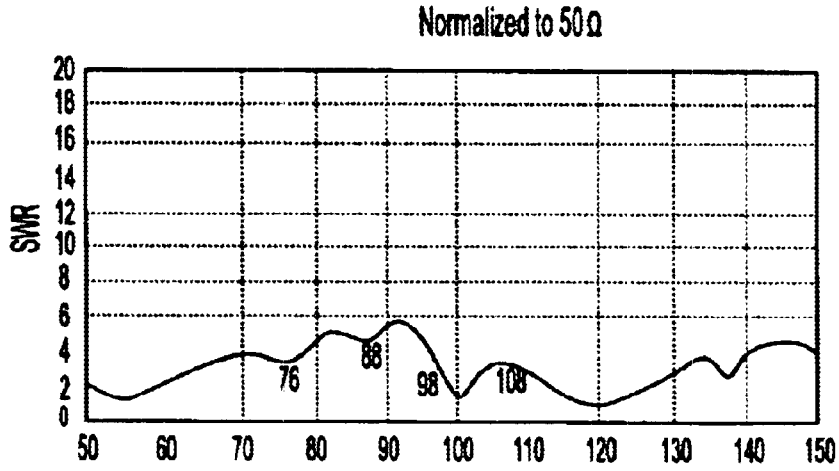
FIG. 28 is a plot of the test results of the wire pattern layout shown in FIG. 27.

FIG. 27 shows a wire pattern layout in which four "rhomboidal" antenna wires 74 traverse the heater grid. In this embodiment, the distances were approximately: a=20 cm; b=16; c=15 cm;d=15 cm; e=4 cm; and f=11 cm. The results of the testing of this embodiment are shown in FIG. 28.

Figure 29:
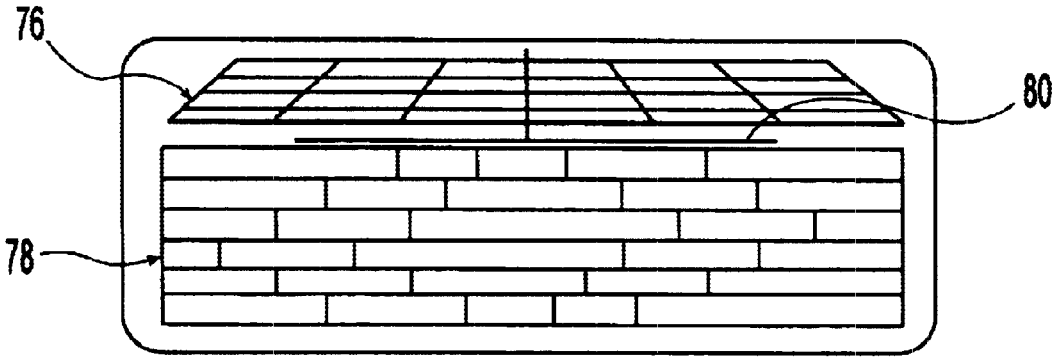
FIG. 29 is a diagram of one exemplary embodiment of a wire pattern layout of the present invention.

FIG. 29 illustrates a wire pattern layout that includes a wire array 76 that is situated above and substantially adjacent to a wire array 78. The wire array 76 includes an antenna line 80. The antenna line 80 is situated sufficiently adjacent to the wire array 78 to form a capacitive or electromagnetic connection. The wire array 76 is comprised of a plurality of intersecting antenna wires, such as described with regard to FIG. 7. On the other hand, the wire array 78 is similar to the embodiment of FIG. 4 in that a plurality of antenna wires traverse the heater grid in a step-wise pattern. In one variation of the embodiment shown in FIG. 29, the upper wire array may be in direct electrical communication with the lower wire array.

Figure 30:
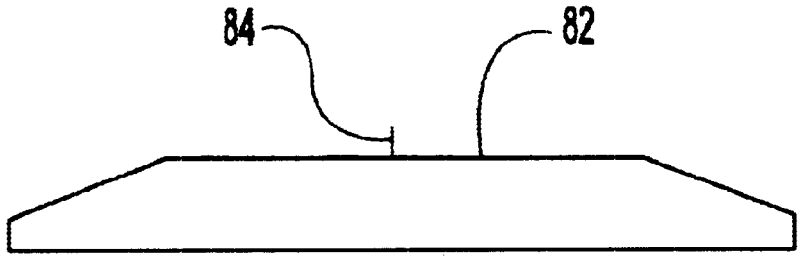
FIG. 30 is a diagram of an exemplary embodiment of an antenna layout of the present invention.

FIG. 30 shows a film embodiment of a layout of the present invention. In this embodiment, a metallic film 82 is in electrical communication with an antenna feed 84. The metallic film 82 may have any suitable shape for facilitating RF transmission in the desired frequency band. The metallic film 82 may be transparent for use in a window embodiment, for example. However, it should also be recognized that the metallic film 82 may be translucent or opaque in other embodiments. The metallic film 82 may be supported in any suitable dielectric material including, but not limited to, glass, polycarbonate, plastic, or any other similar, suitable, or conventional dielectric material. The metallic film 82 may be secured to an outer surface or in between layers of the dielectric material using any suitable manufacturing technique such as vacuum deposition or extrusion. For example, the metallic layer 82 may be sputtered on an outer surface or in between layers of the dielectric material.

Similar to the wire pattern layout of FIG. 7, the metallic film 82 may be used alone or in conjunction with at least one other antenna wire pattern. In other words, the metallic layer 82 may be in direct electrical communication with, or electromagnetically coupled to, another antenna wire pattern. For example, the metallic film 82 may be substituted for the upper antenna wire patterns of the embodiments shown in FIGS. 17, 19, 21, and 29.

Figure 31:
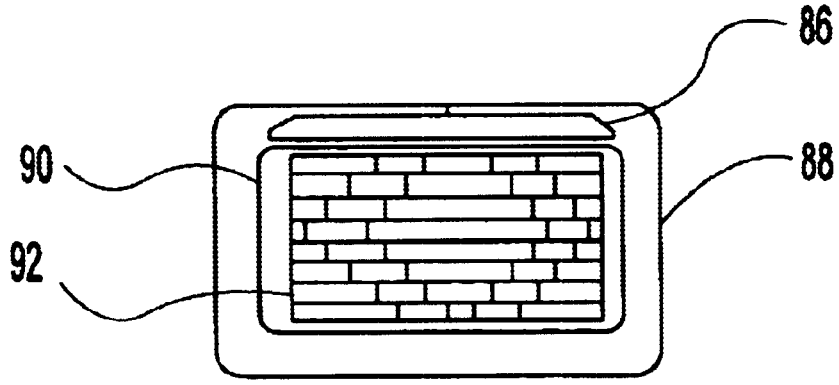
FIG. 31 is a diagram of one embodiment of a window antenna of the present invention.

In one embodiment, the metallic layer 82 may be supported by a plastic frame that extends at least partially around a glass window. FIG. 31 shows one example of this embodiment. In FIG. 31, the metallic layer 86 is supported by a plastic frame 88. The plastic frame 88 extends around a glass panel 90 which has a heater grid pattern 92. As shown in this embodiment, the metallic film may be in direct communication with, or electromagnetically coupled to, another antenna wire pattern that intersects the heater grid pattern 92. In one variation of this embodiment, a metallic film may be substituted for the heater grid pattern, wherein the metallic film may be adapted to block infrared radiation and/or to conduct electricity for heating purposes. Furthermore, it should be recognized that any other embodiment of the present invention may be supported in dielectric material comprised of a plastic frame that extends at least partially around a glass panel.

Figure 32:
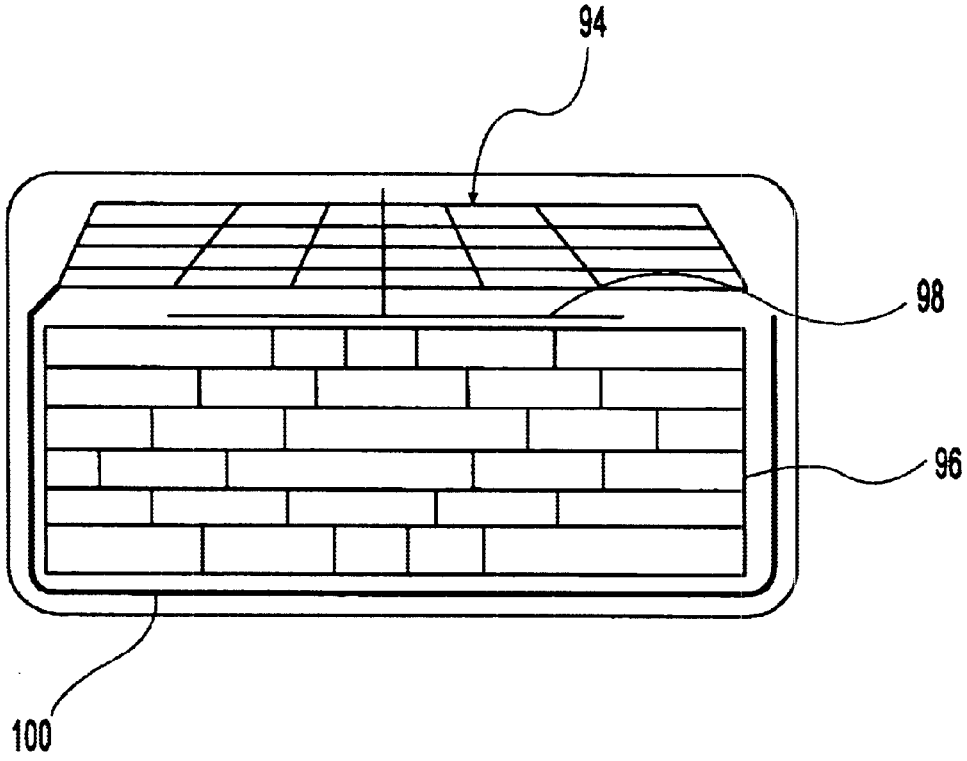
FIG. 32 is a diagram of one embodiment of a wire pattern layout of the present invention.

FIG. 32 shows another example in which one wire pattern layout is electromagnetically coupled to another wire pattern layout. In this example, wire pattern array 94 is electromagnetically coupled to wire pattern array 96 via an antenna line 98 of wire pattern array 94. In a variation of this example, the wire pattern array 94 may be in direct electrical communication with the wire pattern array 96. The wire pattern array 94 also has an antenna line 100 that may extend at least partially around the periphery of the wire pattern array 96. The inventors have surprisingly discovered that the antenna line 100 may be useful to improve reception in the AM band.

In this example, the main grid of wire pattern array 94 is comprised of a plurality of intersecting wires similar to the embodiment of FIG. 7. The wire pattern array 94 may also be similar to the upper patterns of FIGS. 17, 19, or 21 or any other embodiment having a plurality of intersecting antenna wires. It should also be recognized that a metallic film similar to the example of FIG. 30 may be substituted for the main grid of wire pattern array 94. On the other hand, the wire pattern array 96 may be comprised of at least one antenna wire that intersects a heater grid. For example, the wire pattern array 96 may be similar to the examples of FIGS. 2, 3, 4, 9, 11, 13, 15, 23, 25, 27, or any other suitable embodiment in which at least one antenna wire intersects a heater grid.

The present invention includes other embodiments that may be obtained by combining or substituting the exemplary embodiments. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A wire pattern layout for an antenna, said wire pattern layout comprising:

a plurality of power wires adapted to be in electrical communication with a power source; and an antenna wire adapted to be in electrical communication with a feed to a radio frequency device, said antenna wire having a configuration that extends at an oblique angle across said power wires;

wherein said configuration is a step pattern.

2. The wire pattern layout of claim 1 wherein said power wires are substantially parallel.

3. The wire pattern layout of claim 1 wherein said power wires are arranged in rows.

4. The wire pattern layout of claim 1 wherein said power wires are heating elements.

5. The wire pattern layout of claim 1 wherein said antenna wire intersects each of said power wires at an angle of approximately 90 degrees.

6. The wire pattern layout of claim 1 wherein said step pattern has at least one change of direction.

7. The wire pattern layout of claim 1 wherein said power wires and said antenna wire are printed lines supported by at least one dielectric panel.

8. The wire pattern layout of claim 7 wherein said at least one dielectric panel is a window.

9. The wire pattern layout of claim 1 wherein said antenna wire is adapted to be in electrical communication with said feed to said radio frequency device, said radio frequency device selected from the group consisting of AM radios, FM radios, AM/FM radios, CB radios, global positioning systems, cellular phones, and combinations thereof.

10. The wire pattern layout of claim 1 further comprising at least one additional antenna wire adapted to be in electrical communication with said feed to said radio frequency device, each additional antenna wire having a configuration that extends at an oblique angle across said power wires.

11. A wire pattern layout for an antenna, said wire pattern layout comprising:

at least one dielectric panel;

a plurality of power wires supported by said at least one dielectric panel, said power wires in electrical communication with a power source;

a feed in electrical communication with a radio frequency device, said feed supported by said at least one dielectric panel; and a plurality of antenna wires in electrical communication with said feed, at least one of said antenna wires having a configuration that extends at an oblique angle across said power wires;

wherein said configuration is a step pattern.

12. The wire pattern layout of claim 11 wherein said antenna wire having said configuration intersects each of said power wires at an angle of approximately 90 degrees.

13. The wire pattern layout of claim 11 wherein said step pattern has at least one change of direction.

14. The wire pattern layout of claim 11 wherein said feed, said power wires, and said antenna wires are printed lines.

15. A wire pattern layout for an antenna, said wire pattern layout comprising:

a feed adapted to be in electrical communication with a radio frequency device;

a first wire array in electrical communication with said feed, said first wire array comprising a plurality of intersecting antenna wires; and a second wire array comprising:

a plurality of power wires adapted to be in electrical communication with a power source; and at least one antenna wire traversing said power wires, said at least one antenna wire electromagnetically coupled to said first wire array;

wherein said at least one antenna wire of said second wire array is arranged in a step pattern.

16. The wire pattern layout of claim 15 wherein said intersecting antenna wires of said first wire array include:

a plurality of approximately horizontally oriented antenna wires; and at least one approximately vertically oriented antenna wire that traverses said approximately horizontally oriented antenna wires.

17. The wire pattern layout of claim 15 wherein said step pattern has at least one change of direction.

18. The wire pattern layout of claim 15 wherein:

said first wire array and said second wire array are supported by a window of an automobile; and said first wire array is situated above and substantially adjacent to said second wire array.

19. The wire pattern layout of claim 15 wherein said first wire array includes an additional antenna wire that extends at least partially around said second wire array.

20. The wire pattern layout of claim 15 further comprising a coupling wire connected to said first wire array, said coupling wire facilitating electromagnetic coupling of said first wire array to said at least one antenna wire of said second wire array.

21. A wire pattern layout for an antenna, said wire pattern layout comprising:

a feed adapted to be in electrical communication with a radio frequency device;

a first antenna wire in electrical communication with said feed; and a wire array comprising:

a plurality of power wires adapted to be in electrical communication with a power source; and a second antenna wire intersecting said power wires, said second antenna wire electromagnetically coupled to said first antenna wire;

wherein said second antenna wire is arranged in a step pattern.

22. The wire pattern layout of claim 21 wherein said step pattern has at least one change of direction.

23. The wire pattern layout of claim 21 wherein:

said first antenna wire and said second antenna wire are supported by a window of an automobile; and said first antenna wire is situated above and substantially adjacent to said second antenna wire.

24. The wire pattern layout of claim 21 further comprising a third antenna wire connected to said first antenna wire, said third antenna wire extending at least partially around said wire array.

25. The wire pattern layout of claim 21 further comprising a coupling wire connected to said first antenna wire, said coupling wire facilitating electromagnetic coupling of said first antenna wire to said second antenna wire.

26. A layout for an antenna, said layout comprising:

a feed adapted to be in electrical communication with a radio frequency device;

a metallic film in electrical communication with said feed;

a wire array comprising a plurality of power wires adapted to be in electrical communication with a power source, said wire array further comprising at least one antenna wire traversing said power wires, said at least one antenna wire electromagnetically coupled to said metallic film; and at least one dielectric panel supporting said metallic film and said wire array wherein said at least one antenna wire of said wire array is arranged in a step pattern.

27. The layout of claim 26 wherein said step pattern has at least one change of direction.

28. The layout of claim 26 further comprising a coupling wire connected to said metallic film, said coupling wire facilitating electromagnetic coupling of said metallic film to said at least one antenna wire.

29. The layout of claim 26 wherein said metallic film is situated above and substantially adjacent to said wire array.

30. The layout of claim 26 further comprising an antenna wire in electrical communication with said metallic film, said antenna wire extending at least partially around said wire array.

31. The layout of claim 26 further comprising:

a first dielectric panel comprised of a first dielectric material that supports said metallic film; and a second dielectric panel comprised of a second dielectric material that supports said wire array.

32. A layout for an antenna, said layout comprising:

a first dielectric panel comprised of a first dielectric material;

a second dielectric panel connected to said first dielectric panel, said second dielectric panel comprised of a second dielectric material;

an antenna supported by said first dielectric panel;

a heater array comprising a plurality of power wires adapted to be in electrical communication with a power source, said heater array supported by said second dielectric panel; and at least one antenna wire traversing said heater array said at least one antenna wire electromagnetically coupled to said antenna;

wherein said at least one antenna wire is arranged in a step pattern.

33. The layout of claim 32 wherein said antenna is comprised of a metallic film.

34. The layout of claim 32 wherein said at least one antenna wire intersects each of said power wires at an angle of approximately 90 degrees.

35. The layout of claim 32 wherein said step pattern has at least one change of direction.

36. The layout of claim 32 further comprising a coupling wire connected to said antenna, said coupling wire facilitating electromagnetic coupling of said antenna to said at least one antenna wire that traverses said heater array.

37. The layout of claim 36 wherein said coupling wire is supported by said first dielectric panel.

38. The layout of claim 32 wherein said first dielectric material and said second dielectric material are selected from the group consisting of glass, safety glass, plastics, polycarbonate, plexiglass, and fiberglass.

39. The layout of claim 38 wherein:

said first dielectric panel is a plastic panel; and said second dielectric panel is a glass panel.

40. The layout of claim 32 further comprising an antenna wire in electrical communication with said antenna, said antenna wire extending at least partially around said heater array.

41. The layout of claim 40 wherein said antenna wire is supported by said first dielectric panel.

* * * * *

UNITED STATES PATENT AND TRADEMARK OFFICE

CERTIFICATE OF CORRECTION

PATENT NO. : 6,693,597 B2
DATED : February 17, 2004
INVENTOR(S) : Walton et al.

It is certified that error appears in the above-identified patent and that said Letters Patent is hereby corrected as shown below:

Title page,
Item [75], Inventors, please change the city noted for Martino Rosin from "Vicehza" to the correct spelling of -- Vicenza. --
Item [73], Assignee, please change the "Calear s.r.1." to the correct spelling of -- Calearo S.r.1. --

Column 1,
Line 14, please delete "For m instance," and insert -- For instance, --
Line 49, please delete "adapted to, be in" and insert -- adapted to be in --

Column 3,
Line 67, please delete "pattern lay out of" and insert -- pattern layout of --

Signed and Sealed this

Twenty-fifth Day of May, 2004

JON W. DUDAS
*Acting Director of the United States Patent and Trademark Office*